United States Patent [19]

Kyte

[11] 4,191,226

[45] Mar. 4, 1980

[54] BASKET FILLER

[76] Inventor: Garrett J. Kyte, Ewell, Md. 21824

[21] Appl. No.: 872,229

[22] Filed: Feb. 15, 1978

[51] Int. Cl.[2] ..... B65B 1/04

[52] U.S. Cl. ..... 141/391; 217/124

[58] Field of Search ..... 141/391, 365, 369, 370, 141/372; 220/86 R; 217/124

[56] References Cited

U.S. PATENT DOCUMENTS

| | | | |
|---|---|---|---|
| 1,122,307 | 12/1914 | Rhodes | 220/86 R |
| 1,342,569 | 6/1920 | Pick | 141/365 |

FOREIGN PATENT DOCUMENTS

| | | | |
|---|---|---|---|
| 337307 | 10/1930 | United Kingdom | 217/124 |

*Primary Examiner*—Willis Little

*Attorney, Agent, or Firm*—John W. Huckert

[57] ABSTRACT

A basket filler for use in filling with marine life a basket having handles extending outwardly therefrom comprising a body which is frusto-conical in shape having open ends, one of which is larger than the other, the larger end having an outwardly extending flange portion transverse to the central axis of the filler with a circumferential skirt extending axially from the outer circumference of the flange portion, and the extending flange portion including at least one pair of diametrically opposed slots provided therein for reception of the pair of basket handles therethrough when the filler is mounted upon the basket, and at least one of the slots being open through the outwardly extending flange portion and the axial skirt to the outside.

2 Claims, 4 Drawing Figures

BASKET FILLER

This invention is called a Basket Filler, used on the top of a basket or barrel. The purpose of the Basket Filler is to prevent Crabs, Fish, Ells, etc., from crawling out of the basket while the basket is being filled to the top.

SUMMARY OF THE INVENTION

A Basket Filler is made in one piece. The top is open, and round, and bends toward the inside. The side is round, and from the top it tapers down to a larger diameter bottom. The bottom is also open and round. The bottom bends outward and then downward. The bottom part that bends outward has two slots and two cut out slots.

The Basket Filler is to be placed on top of the basket or barrel, while the basket or barrel is being filled with Crabs, Fish, Ells, etc., to prevent them from getting out.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

The Basket Filler is manufactured in one piece. The description is given in four figures of the drawings.

The Basket Filler is made from sheets of aluminum, or tin, or when made from plastic, is made in a mold. Tin or aluminum preferably being of a thickness of 1/32 of 1 inch. Plastic preferably being of a thickness of 1/16 of 1 inch.

Figure 1:
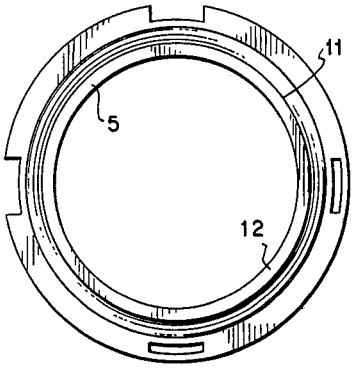
FIG. 1 showing the top of the Basket Filler.
Figure 2:
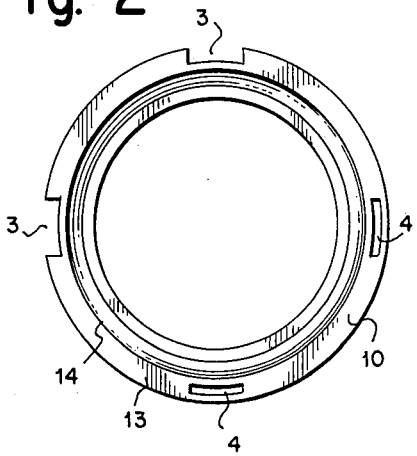
FIG. 2 showing the bottom of the Basket Filler.
Figure 3:
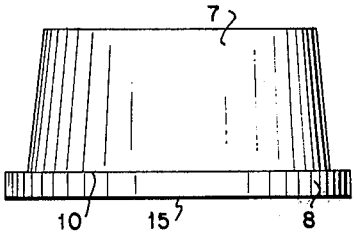
FIG. 3 showing a side view of the Basket Filler.
Figure 4:
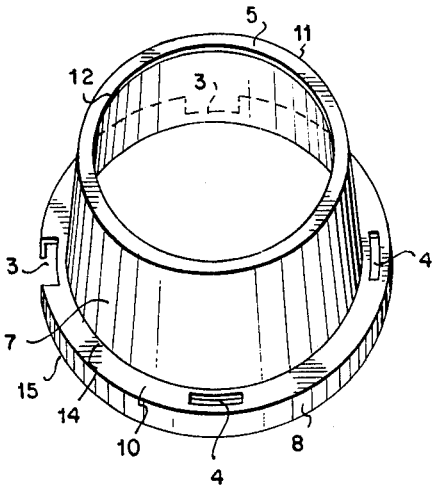
FIG. 4 showing an over all view in perspective of the Basket Filler.

Drawing FIG. 1, a top view shows the diameter of the top which is 16 inches outside to outside. The diameter of the top is 15 inches inside to inside. Drawing FIG. 2 a bottom view, shows the diameter of the bottom which is 19 inches, outside to outside. The inside circle is 17 inches in diameter and is one inch higher than the 19 inch diameter bottom circle. There are 2 slots and 2 cut out slots, one inch above the bottom 19 inch diameter circle. FIG. 3, a side view, indicates that the inside diameter, one inch from the bottom is 17 inches in diameter. Drawing FIG. 4, shows that one inch from the bottom there are two slots 4 and two cut out slots 3. The two slots 4 are showing, only one of the cut out slots 3 is showing. The slots and cut out slots are 90 degrees apart. The two slots 4 are 4 inches long and ¼ inch wide. The two cut out slots 3 are 4 inches long. The basket filler height is 9 inches over all.

The Basket Filler sits on top of a basket, or barrel; handle "B" on top of the basket (FIG. 5) is inserted through a slot 4 on bottom of basket filler; Handle "A" on top of basket is inserted through cut out slot 3 on bottom of basket filler. The purpose of the cut out slot "C" on the Basket Filler is to allow the tongue of basket lid to be inserted into handle "A" of basket, while basket filler is still sitting on top of the basket. When basket is filled to the top with Crabs, Fish, Ells, etc. the basket filler can be removed quickly, and the basket lid shown in FIG. 6 (with the tongue already inserted in handle "A" of the basket) can be closed quickly over the top of the basket, inserting the other tongue of the basket lid into handle "B" and thereby sealing the basket to prevent Crabs, ells, Fish, ect., from getting out of basket.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to falling within the scope of the invention.

I claim:

1. A basket filler for use in filling with marine life a basket having a pair of handles extending therefrom comprising:

a body which is frusto-conical in shape having open ends, one of which is larger than the other;

the larger end having an outwardly extending flange portion transverse to the central axis of the filler with a circumferential skirt extending axially from the outer circumference of the flange portion; and means provided on said extending flange portion so the filler can be used upon said basket, whereby a lid for the basket can be associated with one handle of said basket while marine life is being put into the basket through the filler, and permitting quick removal of the filler and immediate closing of the basket lid to prevent escape of said marine life.

2. The filler of claim 1, wherein said means includes at least one pair of diametrically opposed slots provided in said outwardly extending flange portion for reception of the pair of basket handles therethrough when the filler is mounted upon said basket, and at least one of said slots being open through the outwardly extending flange portion and the axial skirt to the outside.

* * * * *